US006960066B2

(12) United States Patent
Koga et al.

(10) Patent No.: US 6,960,066 B2
(45) Date of Patent: Nov. 1, 2005

(54) WATER PUMP WITH A HOLLOW SHAFT, SEAL, AND DRAIN OPENING THEREIN

(75) Inventors: Yojiro Koga, Kariya (JP); Itsuro Hashiguchi, Chiryu (JP); Masaki Chujo, Chiryu (JP); Akihiro Katsumata, Handa (JP); Takumi Hattori, Chiryu (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 59 days.

(21) Appl. No.: 10/369,634

(22) Filed: Feb. 21, 2003

(65) Prior Publication Data

US 2003/0175133 A1 Sep. 18, 2003

(30) Foreign Application Priority Data

Feb. 21, 2002 (JP) ..... 2002-045201
Feb. 28, 2002 (JP) ..... 2002-054039
Feb. 21, 2003 (JP) ..... 2003-044215

(51) Int. Cl.[7] ..... F04B 35/01

(52) U.S. Cl. ..... 417/362; 417/364; 417/313; 417/63

(58) Field of Search ..... 417/362, 364, 417/313, 63

(56) References Cited

U.S. PATENT DOCUMENTS 2,855,909 A 10/1958 Stefan
3,838,899 A 10/1974 Sampatacos
4,890,946 A * 1/1990 von Pragenau ..... 403/13
4,955,786 A * 9/1990 Kunkel et al. ..... 415/110
4,966,572 A * 10/1990 Kunkel et al. ..... 474/199
5,026,253 A 6/1991 Börger
5,125,795 A * 6/1992 Suzuki et al. ..... 415/168.2
5,795,137 A * 8/1998 Ozawa et al. ..... 417/362
6,561,756 B2 * 5/2003 Ozawa et al. ..... 415/111
6,561,770 B2 * 5/2003 Okuda ..... 417/223
2002/0034438 A1 * 3/2002 Ozawa et al. ..... 415/111

FOREIGN PATENT DOCUMENTS

EP 0 289 958 A2 11/1988
JP 2-45698 A 2/1990
JP 4-262096 A 9/1992
JP 404250306 A * 12/1992
JP 11-336699 A 12/1999

* cited by examiner

*Primary Examiner*—Timothy S. Thorpe
*Assistant Examiner*—Emmanuel Sayoc
(74) *Attorney, Agent, or Firm*—Burns, Doane, Swecker & Mathis, LLP

(57) ABSTRACT

A water pump includes a rotation member, a hollow shaft portion having an opening on one end and connected to the rotation member for unitary rotating with the rotation member, an impeller connected to the shaft portion for unitary rotating with the shaft portion, a body defining a fluid chamber in which the impeller is rotated, a bearing for rotatably supporting the shaft portion on the body, a sealing member provided between the shaft portion and the body for sealing the fluid chamber and a cover portion for substantively closing the opening of the shaft portion.

11 Claims, 11 Drawing Sheets

WATER PUMP WITH A HOLLOW SHAFT, SEAL, AND DRAIN OPENING THEREIN

This application is based on and claims priority under 35 U.S.C. § 119 with respect to Japanese Patent Application No. 2002-045201 filed on Feb. 21, 2002, Japanese Patent Application No. 2002-054039 filed on Feb. 28, 2002 and Japanese Patent Application No. 2003-044215 filed on Feb. 21, 2003 the entire content of which are incorporated herein by reference.

FIELD OF THE INVENTION

The present invention relates to a water pump. More particularly, the present invention pertains to a water pump for a vehicle.

BACKGROUND OF THE INVENTION

A known water pump disclosed in Japanese Patent Laid-Open Publication No. H11-336699, a body is fixed to a cylinder block with a fixing member such as bolt, a solid rotational shaft is rotatably supported by the body via a bearing, a pulley is fixed to one end of the rotational shaft via a pulley bracket with a fixing member such as bolt, an impeller is press fitted to be secured to the other end of the rotational shaft, and the impeller and the pulley are rotated as one unit. With the water pump disclosed in Japanese Patent Laid-Open Publication No. H11-336699, the rotational shaft and the pulley are provided separately and are fixed each other by the fixing member. Therefore, the number of the components of the water pump is increased and the structure thereof becomes complex.

A need thus exists for a water pump which has a simple structure while maintaining the strength of the rotational shaft.

SUMMARY OF THE INVENTION

In light of the foregoing, the present invention provides a water pump which includes a rotation member, a hollow shaft portion having an opening on one end and connected to the rotation member for unitary rotating with the rotation member, an impeller connected to the shaft portion for unitary rotating with the shaft portion, a body defining a fluid chamber in which the impeller is rotated, a bearing for rotatably supporting the shaft portion on the body, a sealing member provided between the shaft portion and the body for sealing the fluid chamber and a cover portion for substantively closing the opening of the shaft portion.

BRIEF DESCRIPTION OF THE DRAWING FIGURES

The foregoing and additional features and characteristics of the present invention will become more apparent from the following detailed description considered with reference to the accompanying drawing figures in which like reference numerals designate like elements.

DETAILED DESCRIPTION OF THE INVENTION

Figure 1:
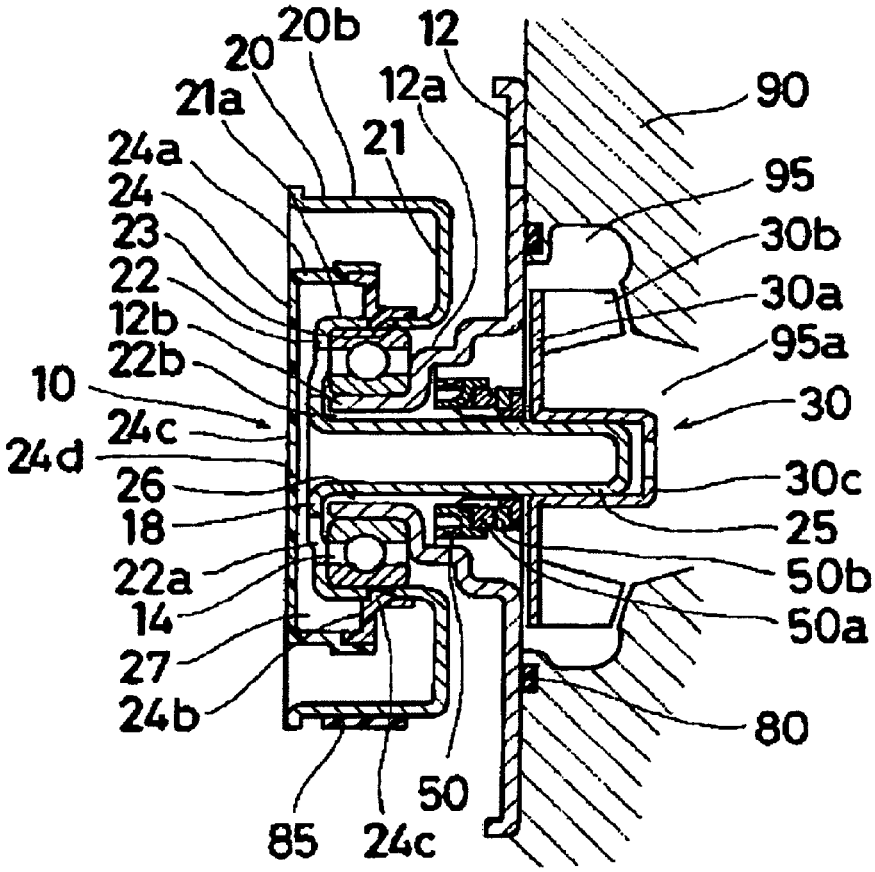
FIG. 1 is a cross sectional view of a water pump according to a first embodiment of the present invention.
Figure 2:
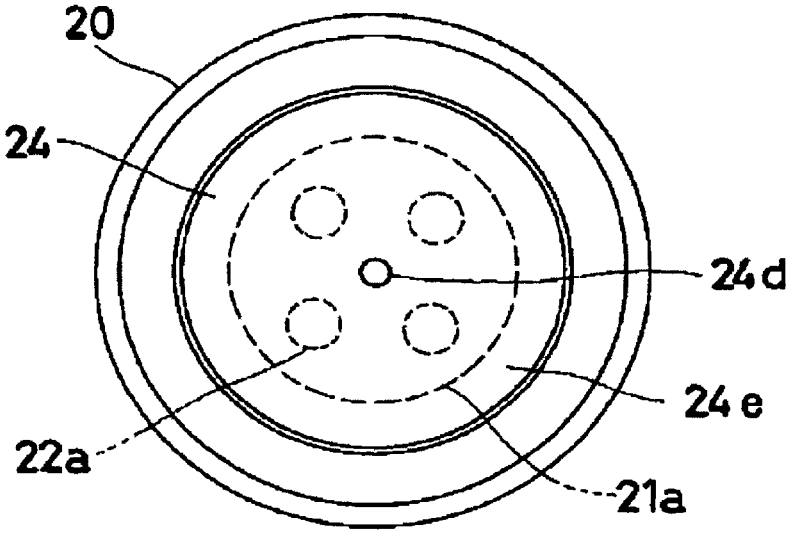
FIG. 2 is a front view of the water pump according to the first embodiment of the present invention.

Embodiments of a water pump will be explained with reference to the illustrations in the drawing figures. Referring to FIGS. 1–2, the water pump of a first embodiment will be explained.

As shown in FIG. 1, a body 12 of a water pump 10 is fixed to an engine cylinder block (i.e., engine body) 90 via a gasket 80 with a connection means (not shown). The body 12 is formed with a stepped cylindrical portion (i.e., cylindrical supporting portion) including a large diameter portion 12*a* and a small diameter portion 12*b* which are provided on a base end (i.e., right end of FIG. 1) and a tip end (i.e., left end of FIG. 1) respectively. An inner ring of a bearing 14 is outfitted to be fixed to the smaller diameter portion 12*b* of the cylinder portion. The right end surface of the inner ring of the bearing 14 is adjacent the large diameter portion 12*a* of the body 12. There may be a clearance between the right end surface of the inner ring and the large diameter portion 12*a*.

A pulley 20 formed with an external peripheral portion 21 having a concave configuration is outfitted to an outer ring of the bearing 14 to be unitary rotated. Engaging bores 23 are formed on an external peripheral surface 21*a* of the external periphery portion 21 outfitted to the bearing 14 keeping equal angular interval one another. A cylindrical cover 24 having a bottom is provided on a front (i.e., left side of FIG. 1) of a pulley 20. The cover 24 includes a cylindrical portion 24*a* with a bottom, a flange portion 24*b* having approximately L shape in cross section and provided on an open end (i.e. right side of FIG. 1) of the cylindrical portion 24*a* with the bottom, and nail portions 24*c* inwardly formed on the inner end of the flange portion 24*b* and positioned corresponding to the engaging bores 23. The nail portions 24*c* are engaged with the engaging bores 23 for fixing the cover 24 to the pulley 20. The cover 24 may be fixed to the pulley using alternative means. The cylindrical portion 24*a* and the flange portion 24*b* of the cover 24 may be made of resin respectively to be water tightly connected with the welding. The cylindrical portion 24*a* and the flange portion 24*b* of the cover 24 may be made of iron plate to be formed as one unit. A small hole 24*d* for communicating the inside of the cover 24 and the atmosphere is formed on a center of a bottom portion 24*e*. Through bores 22*a* for discharging the leaked water droplet via the mechanical seal 50 to the outside are formed keeping equal angular interval from one another on a bottom portion 22 of a rotational body 18 connected to the external peripheral portion 21 having the concave configuration. The bottom portion 22 of the rotational body 18 is unitary formed with a cylindrical shaft portion 25 extended in being away from the bottom portion 22 (i.e., right direction In FIG. 1). The rotational body 18 including the pulley 20, the bottom potion 22, and the shaft portion 25 as one unit is formed by press molding the steel plate so that the pulley 20 and the shaft portion 25 become coaxial. Then, the pulley 20, the bottom portion 22, and the shaft portion 25 are applied with the erosion resistance treatment.

An impeller 30 is unitary rotatably fixed to the right end portion of the shaft portion 25. The impeller 30 includes a base portion 30*a*, a plurality of vanes 30*b* projected from a peripheral portion of the right surface of the base portion 30*a*, and a hollow projection portion 30*c* projected from the central portion of the base portion 30*a* in the right direction of FIG. 1, which are formed in one unit. By outfitting the hollow projection portion 30*c* on the right end portion of the shaft portion 25, the impeller 30 is fixed to the right end portion of the shaft portion 25 to be unitary rotatable. After press molding the steel plate to form the impeller 30, the erosion resistance treatment may be applied to the impeller 30. The impeller 30 is provided in a water chamber 95 which is formed inside of the engine cylinder block 90 and closed with the body 12. The water chamber 95 corresponds to a portion of an engine cooling water circuit (not shown).

The mechanical seal 50 is provided on one end side (i.e., boarder with the water chamber 95) of a cylindrical space 26 defined between the external peripheral surface of the shaft portion 25 and an internal peripheral surface of the large diameter portion 12*a* and the small diameter portion 12*b*. The water chamber 95 is water tightly separated from the outside by the mechanical seal 50 so that the cooling water is not leaked to the outside. The mechanical seal 50 includes a fixing ring 50*a* fixed to the internal peripheral side of the larger diameter portion 12*a* of the cylindrical portion of the body 12 and a rotational ring 50*b* fixed to the shaft portion 25 for contacting the fixing ring 50*a* for always establishing the fluid tight relationship and relative rotational relationship relative to the fixing ring 50*a*.

The operation of the water pump according to the first embodiment will be explained as follows. The pulley 20 is rotated by the rotational force transmitted from the output shaft of an engine (not shown) via a belt 85 engaged with a belt engaging surface 20*b* of the pulley 20. In accordance with the rotation of the pulley 20, the shaft portion 25 unitary formed with the pulley 20 is rotated in the identical direction with the pulley 20. The impeller 30 unitary connected to the shaft portion 25 is rotated in the water chamber 95 which is blocked by the body 12.

Because the water chamber 95 is filled with the cooling water, the impeller 30 moves the cooling water around the center of the water chamber 95 towards the external peripheral direction of the impeller 30 by the centrifugal force caused by the rotation of the impeller 30. Thus, the pumping operation by the centrifugal force is generated from the center of the impeller 30 to the external direction. Accordingly, the differential pressure is generated between the rotational center of the impeller 30 in the water chamber 95 and the external peripheral side of the water chamber 95. And thus, the cooling water is sucked from a suction portion 95*a* provided around the rotational center of the impeller 30 into the water chamber 95. The cooling water is pressurized to be sent to the external peripheral side by the pumping operation of the impeller 30 to be supplied to portions to be cooled of the engine from an outlet portion (not shown) provided on the external peripheral sides. The cooling water is circulated in the foregoing manner.

According to the water pump of the first embodiment of the present invention, the opening of the shaft portion 25 is substantively closed with the cover 24. In case the pump 10 is assembled to the engine body provided in the engine compartment, the water droplet may be applied to the surface of the pump 10 due to the water splash during the vehicle driving. Even in this case, the opening of the shaft portion 25 is substantively closed by the cover 24. Thus, the invasion of the dump and the water droplet to the opening portion can be securely prevented with a simple construction.

Normally, the inside of the shaft portion formed by the press molding is unlikely to be successfully treated by the surface finishing and is apt to be eroded (e.g., rusted). With the water pump of the second embodiment, because the opening is substantively closed, the invasion of the water droplet from the outside can be prevented and the erosion in the shaft portion can be prevented. With this construction, the decline of the strength of the shaft portion 25 due to the rusting in the shaft portion and the water leakage due to the damage of the shaft portion 25 can be prevented and the fitting strength between the pulley 20 and the bearing 14 is increased to prevent the dropping out of the belt from the pulley 20.

As shown above, with the water pump according to the first embodiment, the mechanical 50 is provided between the external peripheral surface of the shaft portion 25 and the internal peripheral surface of the large diameter portion 12*a* of the body 12. Although the water droplet leaked via the mechanical seal 50 is to be leaked via a draining bore 22*b* and the through-bores 22*a*, the leaked water droplet is not drained to the outside by being retained in an annular space 27 formed between the cover 24 and the pulley 20. Thus, it is unlikely to be misjudged that the water leakage is caused in the water pump 10 being observed from the outside and is unlikely to misjudge the water leakage to mislead the exchange of the water pump 10. In addition, because the cover 24 is provided, the leaked water droplet (i.e., LLC) scattered around the water pump due to the rotation of the water pump 10 is not applied to the parts in the engine compartment and the driving belt 85 of the water pump 10. Vapor shaped leaked water is discharged from the small hole 24*d*. Thus, the defective operation due to the application of the water droplet is prevented. Further, because the cover 24 prevents the invasion of the external object such as sand and pebbles via the through-bores 22*a* from the outside, the defective operation causing the water leakage due to the invasion of the external object in the sliding portion of the mechanical seal is prevented. Further, since the nail portions 24*c* are formed on the flange portion 24*b* constituting the annular apace 27, the fixing means can be miniaturized.

According to the first embodiment of the present invention, the scattering of the leaked water droplet by the rotation of the pulley leaked via the mechanical seal, the drain bore, and the through bores can be prevented because the through bores are covered with the cover. In addition, the water leakage caused by the invasion of the external object into the sliding portion of the mechanical seal is prevented by the cover for covering the through bores.

With the first embodiment of the present invention, the water droplet leaked via the mechanical seal, the drain bore and the through bores is temporarily retained.

Figure 3:
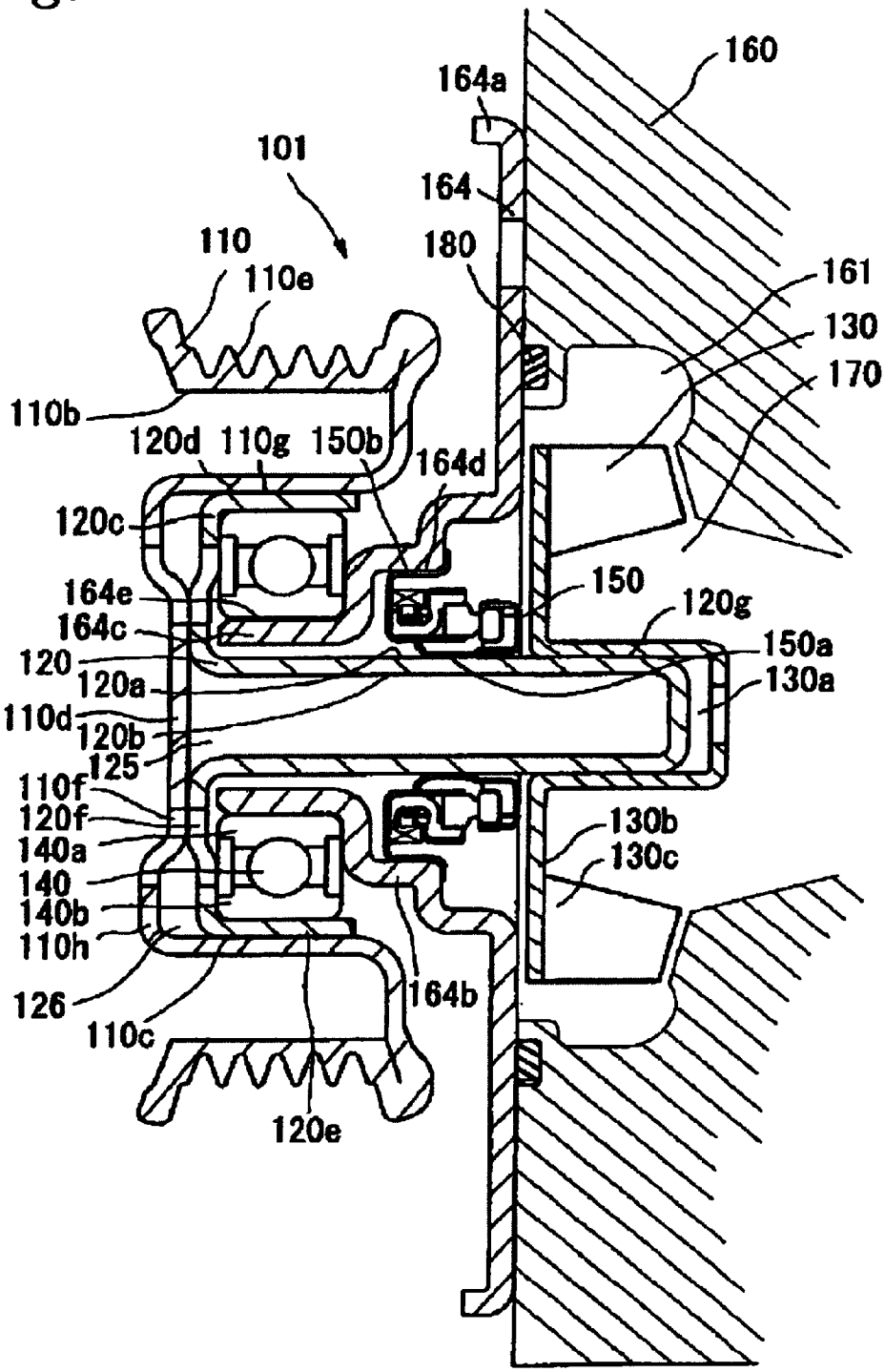
FIG. 3 is a cross sectional view of the water pump according to a second embodiment of the present invention.

A second embodiment of the water pump of the present invention will be explained referring to FIG. 3 as follows. As shown in FIG. 3, a pump 101 includes a shaft portion 120 having an opening 125 on one side in an axial direction and an annular concave portion extended in the axial direction with a cylindrical portion 120*e*, a pulley 110 unitary formed with the shaft portion 120 assembled via an external peripheral surface 120*d* of the shaft portion 120 for rotating synchronized with the rotation of a crankshaft of an engine, a fluid chamber (i.e., corresponding to a water chamber because the cooling water is applied as the fluid) 170, an axial sealing member 150 for sealing the axial direction of the fluid chamber 170, a housing 160, a body 164 fixed to the housing 160, a bearing 140 rotatably supporting the pulley 110 and the shaft portion 120 relative to the body 164 fixed to the housing 160, and an impeller 130 having a plurality of vanes 130*c* in a peripheral direction for unitary rotating with the shaft portion 120.

The pulley 110 is made from a plate member made of metal such as steel by press molding. The pulley 110 includes a cylindrical configuration having a concave portion 110*g* in the center and a plurality of groove portions 110*e* on the external peripheral surface in the axial direction. The groove portions 110*e* of the pulley 110 are provided with a belt having a core wire made of material which is flexible (e.g., alamido fiber) to be connected to the crankshaft and the camshaft so that the pulley 110 rotates synchronized with the rotation of the camshaft for controlling the intake and exhaust air of the engine and the crankshaft of the engine. The pulley 110 can be rotated while maintaining a constant belt tension. That is, the belt is provided on the groove portions 110*e* of the external peripheral surface of the pulley 110 to drive the pulley 110 so that the pulley 110 is rotatably supported relative to the housing 160 which is not rotated.

The shaft portion 120 which is formed by press molding the metal plate is fixed to the concave portion 110*g* of the pulley 110 by press fitting (e.g., welding) so that the pulley 110 is unitary rotated with the shaft portion 120. The center of the shaft portion 120 includes an opening 125 on one side in the axial direction and an annular concave portion is formed on the external peripheral portion. The concave portion in the axial direction of the shaft portion 120 is formed by a cylindrical portion 120*e* projected in the axial direction. The cylindrical portion 120*e* is formed by extending the end of the central portion of the shaft portion 120 in the radial direction, then by bending the end in the axial direction which is the same extended direction of the central portion of the shaft portion 120.

The shaft portion 120 and the pulley 110 are coaxially formed, the cylindrical portion 120*e* of the shaft portion 120 is fitted into the concave portion 110*g* of the pulley 110 so that the pulley 110 and the shaft portion 120 are unitary rotated. In this case, the opening of the shaft portion 120 in the axial direction is covered with a closing-portion 110*d* formed on the axial end portion of the pulley 110. The shaft portion 120 is formed with an opening 120*f* on one end of the end portion 120*c* in the axial direction extended in the radial direction of the shaft portion 120. The pulley 110 is formed with an opening 110*f* on an axial end portion of the closing portion 110*d* of the pulley 110 at a position corresponding to the opening 120*f* in the radial direction under the condition that the shaft portion 120 is press fitted into the concave portion 110*g*.

The impeller 130 includes a disc shaped or propeller shaped base portion 130*b* and the vanes 130*c* projected from the base portion 130*b* in the axial direction. A concave portion 130*a* in which the cylindrical axial end portion 120*g* of the shaft portion 120 is provided is formed in the center of the base portion 130*b* of the impeller 130. The axial end portion 120*g* on the housing side of the shaft portion 120 is press fitted to be fixed to the concave portion 130*a* and the impeller 130 is unitary rotated with the pulley 110.

On the other hand, the housing 160 (e.g., engine body) equipped with the water pump 101 is provided with an intake port and an outlet port (not shown). The housing 160 is formed with a recess portion 161 in which the fluid such as the cooling water and the lubrication oil (i.e., the cooling water in this embodiment) is flowed. When the impeller 130 is rotated, the cooling water is flowed from the inlet port to the outlet port. The engine is cooled down by the cooling water passing through the engine to absorb the heat of the engine.

The body 164 of the pump 101 for assembling the water pump 101 relative to the housing 160 is provided on an end of the housing 160. Although the housing 160 corresponds to the engine body in this embodiment, the housing 160 may be formed by aluminum die casting. The housing 160 may be constructed unitary with a cylinder block of the engine or a timing belt case.

The body 164 includes approximately disc shape which is made from a plate member such as steel plate having corrosion resistant treatment and press molded. As shown in FIG. 3, the body 164 may include a flange having an external diameter end portion 164*a* being slightly bent in the axial direction. The body 164 includes an opening in the center and stepped portions 164*b* having gradually reduced diameter. The body 164 is cylindrically projected in the axial direction. The body 164 is fixed to the housing 160 via a sealing member 180 using a tightening member such as a bolt (not shown). Thus, a space maintained with the sealing between the recess portion 161 in the housing 160 and the body 164 is formed.

The space constructs a fluid chamber (e.g., water chamber in case the cooling water is filled) 170. The impeller 130 is rotatably provided in the water chamber 170.

An axial sealing member 150 is press fitted to be fixed to an internal peripheral surface 164*d* of the stepped portions 164*b* of the body 164. An external peripheral surface 150*b* of the axial sealing member 150 is press fitted to be fixed not to be relatively rotatable to the internal peripheral surface 164*d*. On the other hand, an internal peripheral surface 150*a* of the axial sealing member 150 contacts an external peripheral surface 120*a* of the shaft portion 120. The axial sealing member 150 is assembled to the shaft portion 120 to be slidable relative to the shaft portion 120 while maintaining the sealing performance of the water chamber 170 with the axial sealing member 150. In this case, the shaft portion 120 is rotatably supported by the body 164 so that the shaft portion 120 is relatively rotatable to the shaft portion 120 under the condition that the sealing performance at both sides of the axial sealing member (shown in FIG. 3) is ensured by the axial sealing member 150. The axial sealing member 150 includes a known mechanical seal in this embodiment, thus the detailed explanation of the axial sealing member 150 is omitted.

An inner ring 140*a* of the bearing 140 is pressed fitted to be fixed to an external peripheral surface 164*e* of an internal diameter end portion 164*c* having a cylindrical shape of the body 164. The inner ring 140*a* is fixed not to be relatively rotated. On the other hand, an outer ring 140*b* of the bearing 140 is press fitted to an internal peripheral surface of the cylindrical portion 120*e* of the shaft portion 20 not to be relatively rotatable to the pulley 110. In the second embodiment, the bearing 140 includes a known rolling bearing. Thus, the pulley 110 is rotatably supported by the bearing 140 relative to the body 164 fixed to the housing 160.

The operation of the water pump according to the second embodiment of the present invention will be explained as follows.

The rotational force from a crankshaft which corresponds to an output shaft of an engine drives a belt provided on an external peripheral surface of an external diameter of the pulley 110 to rotate the pulley 110. When the pulley 110 is rotated, the shaft portion 120 which is press molded unitary with the pulley 110 is rotated. Then, the impeller 130 fixed to the shaft portion 120 rotates in the water chamber 170 in the housing 160.

In this case, the cooling water filled in the water chamber 170 as a cooling medium for cooling the engine around the water chamber 170 is introduced to the external peripheral side of the impeller 130 by the centrifugal force in accordance with the rotation of the impeller 130. The differential pressure is generated between the rotational center of the impeller 130 and the external peripheral side in the water chamber 170. Thus, the cooling water is sucked from the intake port provided around the rotation center of the impeller 130 into the water pump. The, cooling water is pressurized to be sent to the external peripheral side of the impeller 130 by the rotation of the impeller 130 to be supplied to each portion to be cooled in the engine from the outlet portion (not shown) provided at the external peripheral side of the impeller 130. The engine is cooled down by the water circulation in the foregoing manner.

In this case, although one end of the pulley (i.e., left side of FIG. 3) 110 is exposed to the atmosphere under the condition that the cooling water is filled in the water chamber 170, the housing 160 and the body 164 is sealed with the sealing member 180. The axial sealing member 150 seals between the external peripheral surface 120*a* of the shaft portion 120 and the internal peripheral surface 164*d* at the stepped portion 164*b* of the body 164 to prevent the invasion of the cooling water to the bearing side via the external peripheral surface 120*a* of the shaft portion 120.

According to the water pump of the second embodiment of the present invention, the opening 125 of the shaft portion 120 is closed with a closing portion 110*d* of the pulley 110. In case the pump 101 is assembled to the engine body provided in the engine compartment, the water droplet may be applied to the surface of the pump 101 due to the water splash during the vehicle driving. Even in this case, the opening 125 of the shaft portion 120 is securely closed by the closing portion 110*d* by fixing the shaft portion 120 to a recess portion 110*g* of the pulley 110 by press fitting. Thus, the invasion of the dump and the water droplet to the opening portion 125 can be securely prevented with a simple construction.

Normally, the inside of the shaft portion 120 formed by the press molding is unlikely to be successfully treated by the surface finishing and is apt to be eroded (e.g., rusted). With the water pump of the second embodiment, because the opening 125 is closed, the invasion of the water droplet from the outside can be prevented and the erosion in the shaft portion can be prevented. With this construction, the decline of the strength of the shaft portion 120 due to the rusting in the shaft portion and the water leakage due to the damage of the shaft portion 120 can be prevented and the fitting strength between the pulley 110 and the bearing 140 is increased to prevent the dropping out of the belt from the pulley 110.

Further, with the water pump of the second embodiment of the present invention, even when temporary leakage is generated in case the external object invades into the axial sealing member 150, the cooling water is introduced from the water chamber 170 to one end of the bearing 140 via the axial sealing member 150 and the external peripheral surface 120*a* of the shaft portion 120. Notwithstanding, because the opening 120*f* having a size slightly smaller than the size between the outer ring 140*b* of the bearing 140 and the internal diameter end portion 164*c* of the body 164 is formed on one axial end portion (i.e., flange portion) 120*c* of the shaft portion 120 in the pump 101, the cooling water leaked in the axial direction from the opening 120*f* is retained in a space 260 formed by an axial end portion 110*h* and the axial end portion 120*c* of the shaft portion 120.

Thus, the water pump of the second embodiment of the present invention includes a drain pocket function which is capable of retaining the small amount of leaked cooling water leaked from the water chamber 170 via the axial sealing member 150 in the space 126. By retaining the small amount of the leaked cooling water which is not recognized being leaked due to the defective of the sealing in the space 126, the leakage of the cooling water to the outside of the pump can be prevented. Thus, the reliability of the water pump is improved.

A third embodiment of the water pump according to the present invention will be explained referring to FIG. 4 as follows. With the second embodiment of the water pump shown in FIG. 3, the pulley 110 is constructed with two members by press fitting the shaft portion 120 which is different member from the pulley 110 into the recess portion 110*g* of the pulley 110. In the water pump of the third embodiment, a pulley 211 is constructed by insert molding a shaft portion 221 by resin. Because other construction of a pump 201 of the third embodiment is the same with the pump 101 of the second embodiment, the explanation is not repeated.

With the pump 201 of the third embodiment, an inner ring 240*a* of a bearing 240 is press fitted to a body 264 fixed to the engine via a tightening member 265 such as bolt not to be relatively rotated. An outer ring 240*b* of the bearing 240 is press fitted to be fixed to a recess portion 221*g* formed on an external peripheral portion of the shaft portion 221 having a cylindrical axis in the center.

The shaft portion 221 having the cylindrical configuration in the center is formed by press molding. As shown in FIG. 4, one end of the shaft portion 221 is extended in radial direction to be bent to be extended in the axial direction again to form a cylindrical portion 221*e*. Further, flange shaped end portion 221*f* is formed in the radial direction of the shaft portion 221. The pulley 211 is formed with the resin molding on the external diameter of the cylindrical portion 221*e* including the flange 221*f*. The pulley 211 includes a cylindrical configuration in the axial direction. Groove portions 211*e* being provided with a belt (not shown) are unitary formed on the external periphery surface of the pulley 211. A closing portion 211*d* for closing a central opening of the shaft portion 221 is formed with the resin for insert molding the shaft portion 221.

Figure 4:
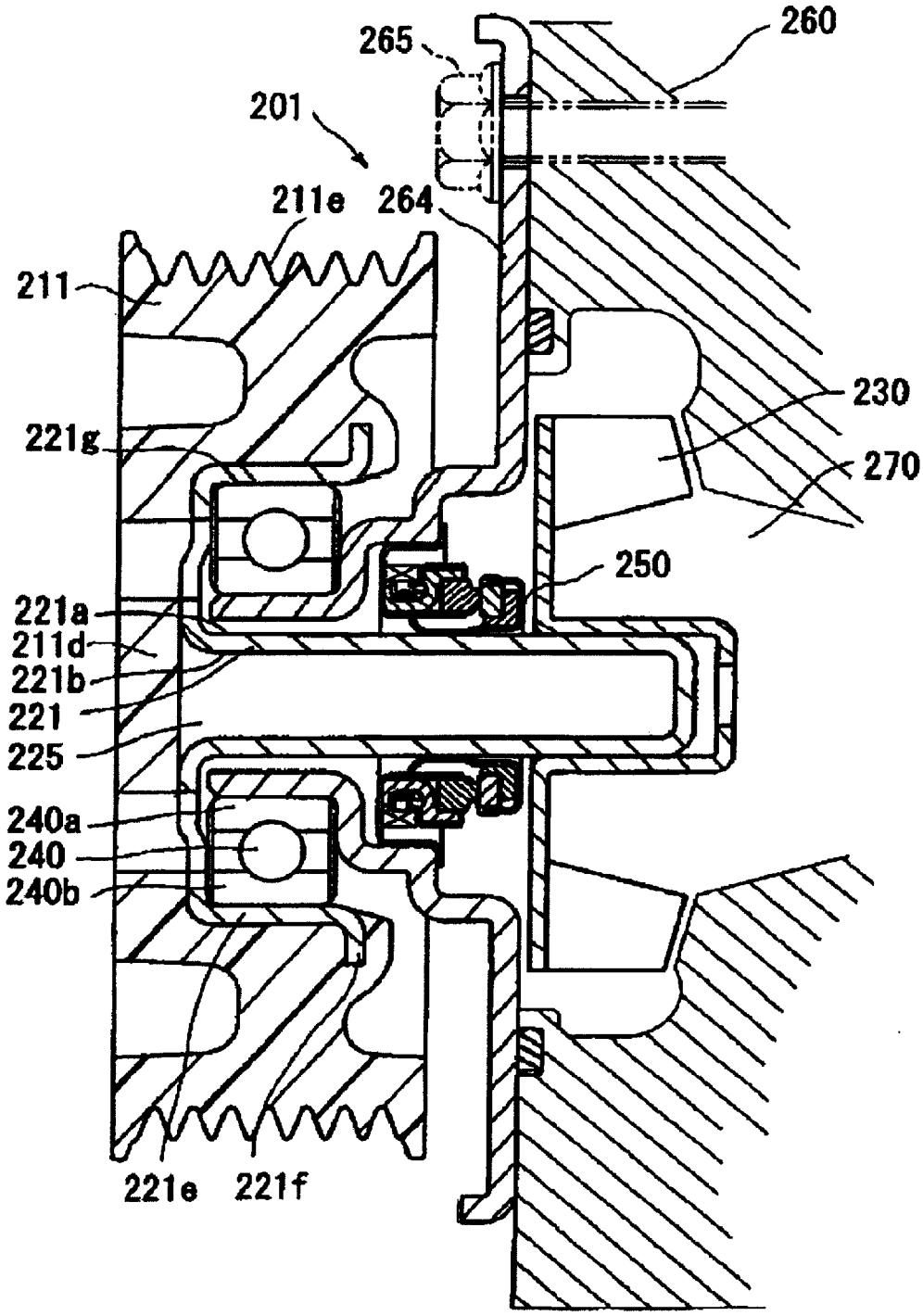
FIG. 4 is a cross sectional view of the water pump according to a third embodiment of the present invention.

Thus, when the pump 201 is assembled to the engine body provided in the engine compartment of the vehicle, even when the water droplet is applied to the surface of the pump 201 shown in FIG. 4 due to the water splash during the vehicle driving, the opening 225 is securely closed by the closing portion 211*d*. Thus, the invasion of the dump and the water droplet into the opening 225 can be prevented by the simple construction. With this construction, the water droplet does not invade into the inside of the shaft, which prevents the rusting of the internal surface of the shaft. In addition, not only preventing the decline of the strength of the shaft portion 221 and the water leakage due to the damage of the shaft portion 221, but also-preventing the dropping out of the belt from the pulley 211 by improving the fitting strength between the pulley 211 and the bearing 240.

Figure 5:
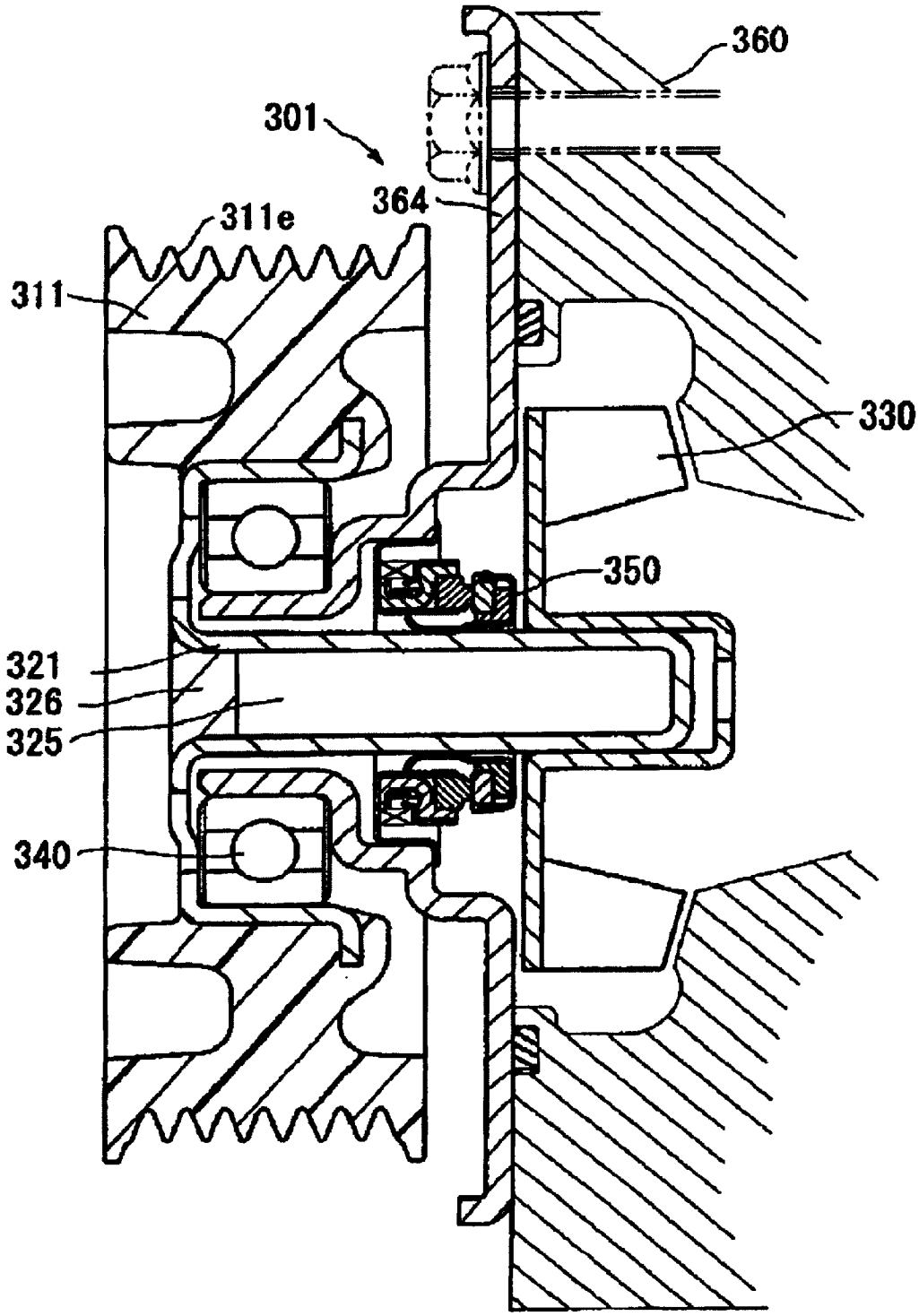
FIG. 5 is a cross sectional view of the water pump according to a fourth embodiment of the present invention.

A fourth embodiment of the water pump according to the present invention will be explained referring to FIG. 5. With the water pump of the fourth embodiment, the basic construction is the same as the water pump according to the third embodiment. As shown in FIG. 4, according to the water pump of the third embodiment, the closing portion 211*d* for closing the opening 225 is resin molded when forming the pulley 211 by resin molding relative to the shaft portion 221. On the other hand, with the water pump of the fourth embodiment, the same effect with the third embodiment can be obtained by closing an opening 325 of a shaft portion 322 with a separated closing member 326 different from the resin for forming a pulley 311 (e.g., plug member made of resin, rubber, or plastic).

Figure 6:
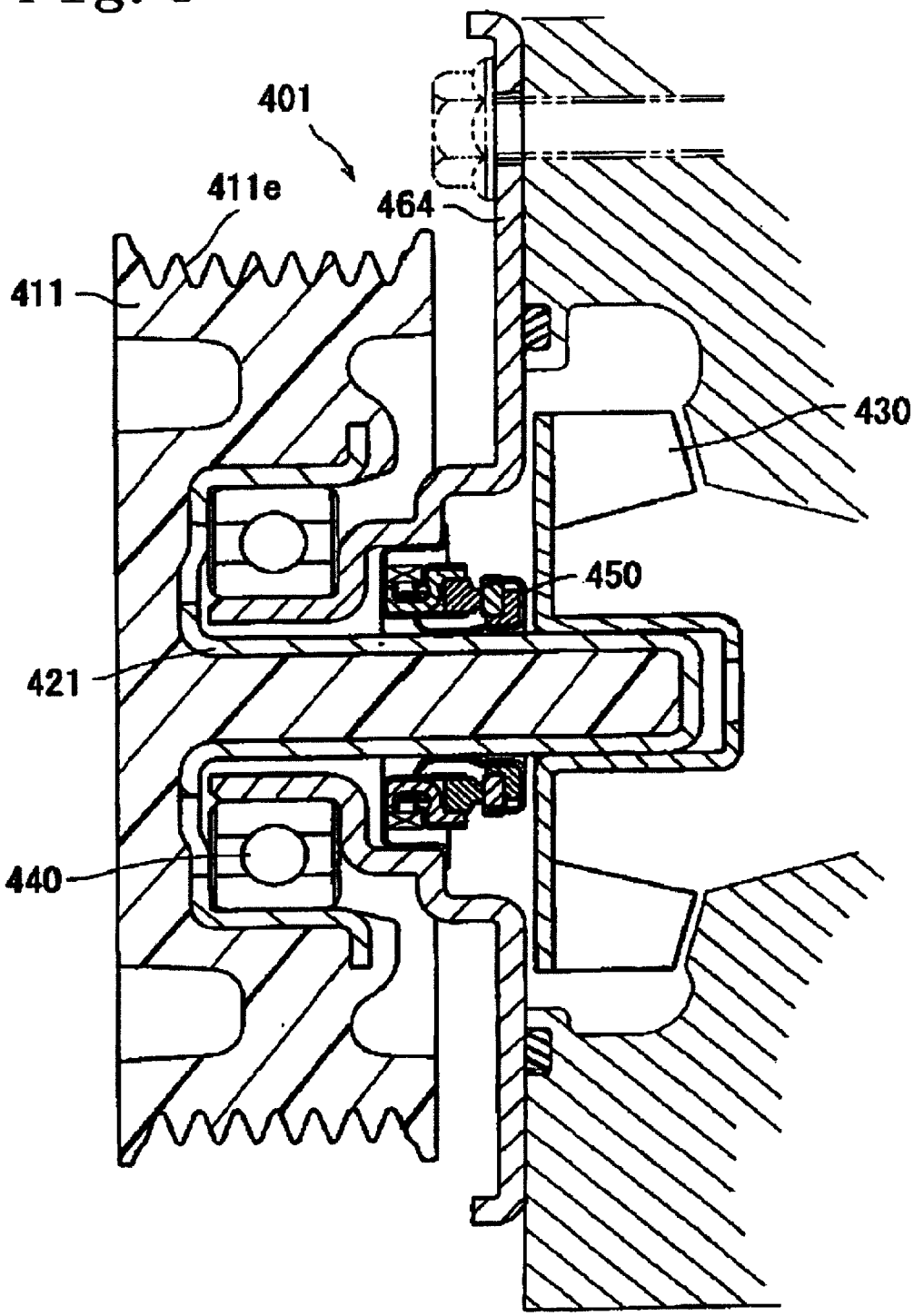
FIG. 6 is a cross sectional view of the water pump according to a fifth embodiment of the present invention.

A fifth embodiment of the water pump according to the present invention will be explained with reference to FIG. 6. The basic construction of the water pump of the fifth embodiment is the same with the water pump of the third embodiment shown in FIG. 4. Although the opening of the shaft portion 221 of FIG. 4 is closed by the resin molding only at an end portion, the entire opening of a shaft portion 422 is closed by charging the resin according to the fifth embodiment shown in FIG. 6. With this construction, because the opening is completely closed by the resin, the water droplet does not enter the shaft and the shaft portion 421 can be further securely protected of being eroded due to the water droplet.

Figure 7:
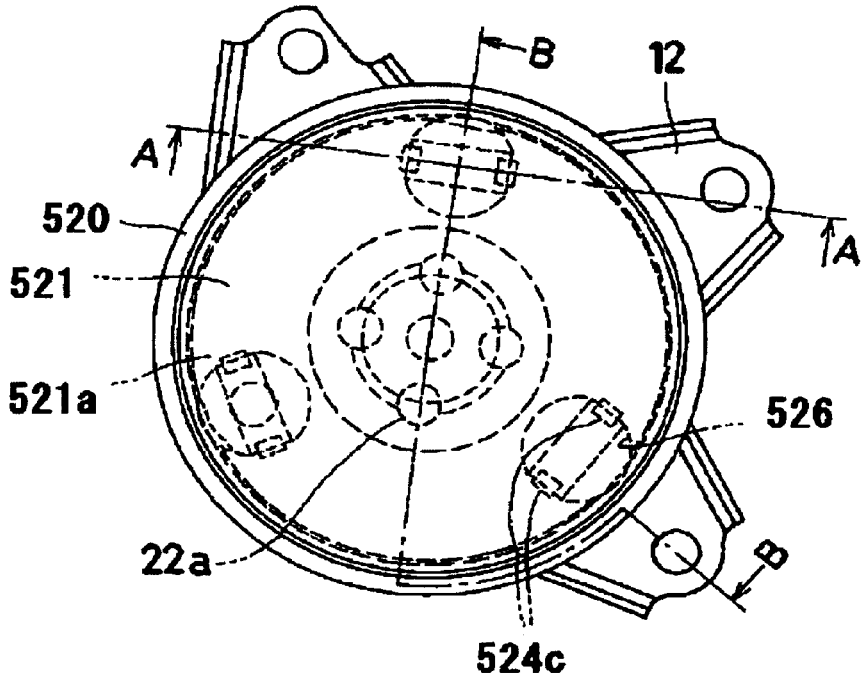
FIG. 7 is a front view of the water pump according to a sixth embodiment of the present invention.
Figure 8:
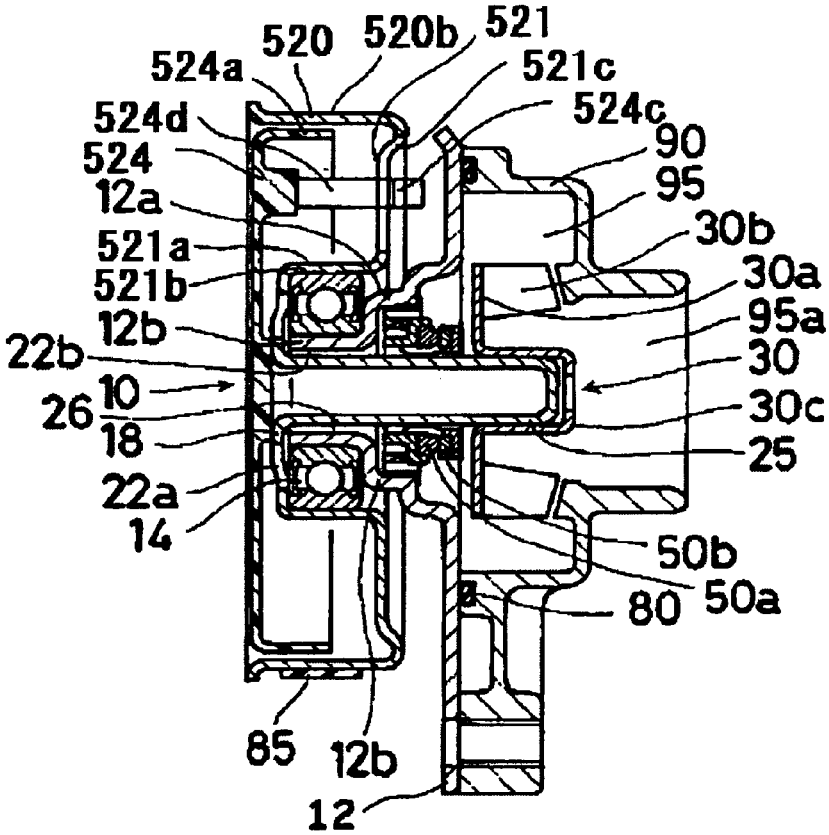
FIG. 8 is a cross sectional view taken on line B—B of FIG. 7.
Figure 9:
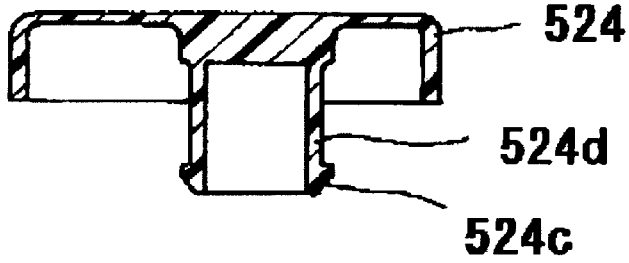
FIG. 9 is a cross sectional view taken on line A—A of FIG. 7.

A sixth embodiment of the water pump of the present invention will be explained referring to FIGS. 7 to 9 as follows. As shown in FIGS. 7 and 8, holes 526 are formed in the circumferential direction on a connecting portion 521*c* which connects between a belt transmitting portion 520*b* constituting an outer circumference portion 521 and a fixing portion 521 *b* constituting an outer circumference surface 521*a*. The cover 524 includes plural pair of projecting portions 524*d* each of which has the nail portion 524*c* being engaged with the hole 526. A circular space may be formed on cylindrical portion 524*a* of a cover 524. In FIGS. 7 to 9, the same parts as compared with FIG. 1 and FIG. 2 are identified by the same reference numerals.

In the sixth embodiment, since the holes 526 are formed on the connecting portion 521 *c*, it is able to form a straight portion 526*a* with a high degree of accuracy and it is able to increase the strength of the engagement between the nail portions 524*c* and the straight portion 526*a*. Further, since the nail portions 524*c* are disposed in the circumferential direction, the nail portions is not affected by a centrifugal force and the strength of the engagement between the nail portions 524*c* and the straight portion 526*a* can be improved.

Figure 10:
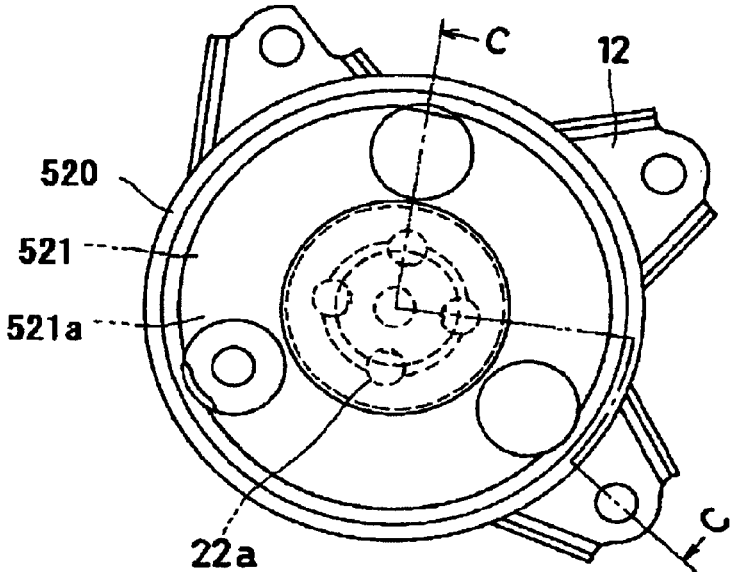
FIG. 10 is a front view of the water pump according to a seventh embodiment of the present invention.
Figure 11:
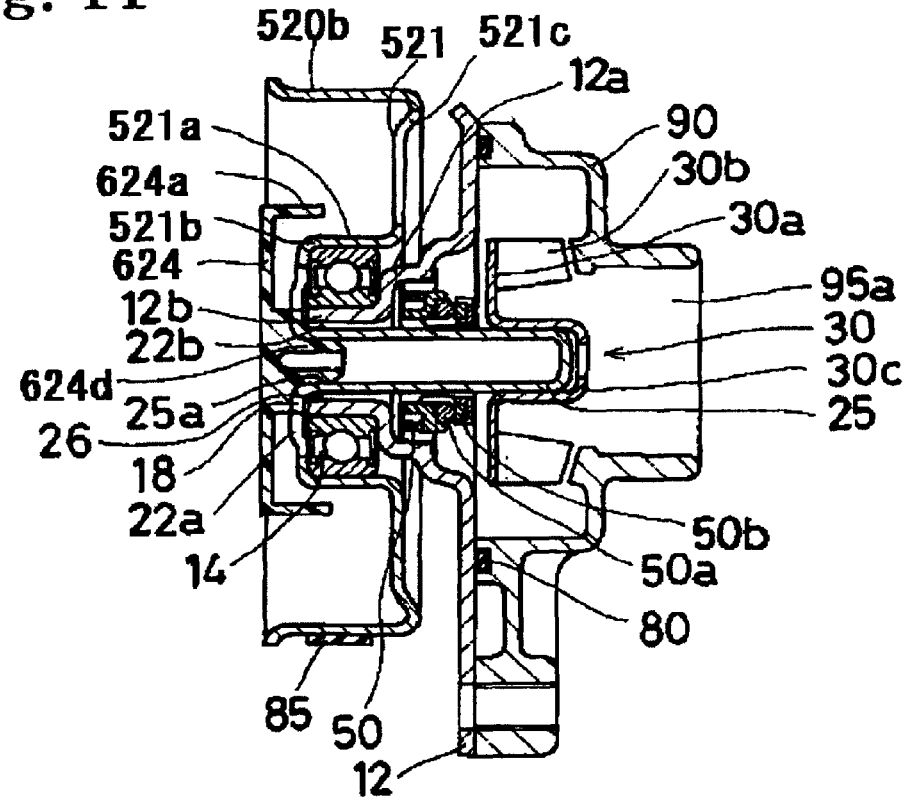
FIG. 11 is a cross sectional view taken on line C—C of FIG. 10.

A seventh embodiment of the water pump of the present invention will be explained referring to FIGS. 10 and 11 as follows. As shown in FIGS. 10 and 11, a cover 524 includes a projecting portion 524*d* which engages with the opening 25*a* of the shaft portion 25. A circular space may be formed on cylindrical portion 524*a* of a cover 524. In FIGS. 10 and 11, the same parts as compared with FIGS. 7 to 9 are identified by the same reference numerals.

In the seventh embodiment, since it is able to fix the cover 624 by fitting the projecting portion 624*d* into the opening 25*a*, it is able to simplify the work operation for assembling.

According to the embodiments of the present invention, because the opening the shaft portion is substantively closed by the cover or the closing portion of the rotational member, the invasion of the water droplet from the outside into the inside of the opening can be securely prevented. Thus, the water droplet is not retained at the opening portion of the shaft portion, which protects the shaft portion. Accordingly, the deterioration of the shaft portion due to the rusting, the perforation, the water leakage in the shaft portion can be securely prevented and the reliability of the water pump can be increased.

Although the embodiments are explained by applying the pump to the water pump for the vehicle, the invention is not limited to the foregoing embodiments and the pump can be applied to the output pump for outputting the fluid (e.g., operation fluid) to the outside in the hydraulic pressure device.

The principles, preferred embodiment and mode of operation of the present invention have been described in the foregoing specification. However, the invention which is intended to be protected is not to be construed as limited to the particular embodiments disclosed. Further, the embodiment described herein is to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A water pump comprising:

a rotation member, a hollow shaft portion having an opening on one end and connected to the rotation member for unitarily rotating with the rotation member;

an impeller connected to the shaft portion for unitarily rotating with the shaft portion;

a body defining a fluid chamber in which the impeller is rotated;

a bearing rotatably supporting the shaft portion on the body;

a sealing member provided between the shaft portion and the body for sealing the fluid chamber;

a cylindrical space defined between an external peripheral surface of the shaft portion and an internal peripheral surface of a cylindrical portion of the body, the sealing member being intermediately located in the cylindrical portion and dividing the cylindrical space into an impeller side portion and a bearing side portion, a drain opening provided at an end of the cylindrical space for discharging water leaked from the impeller side portion to the bearing side portion via the sealing member to an atmosphere;

a through-bore provided either on the rotation member or the shaft portion for establishing a communication between the drain opening and the atmosphere; and a cover portion covering the opening of the shaft portion and the through-bore.

2. A water pump according to claim 1, wherein the cover portion includes a cylindrical configuration having a bottom and is fixed to an external peripheral surface of the rotation member for covering the through-bore and the shaft portion.

3. A water pump according to claim 2, wherein the cover portion is fixed to the external peripheral surface of the rotation member via a fixing means.

4. A water pump according to claim 2, further comprising an annular space defined between the rotation member and the cover portion.

5. A water pump according to claim 3, wherein the fixing means comprises nail portions provided at inner end of the cover portion and engaging bores provided on the rotation member corresponding to the nail portions.

6. A water pump according to claim 1, wherein the cover portion is provided on the rotation member.

7. A water pump according to claim 6, wherein the cover portion and the rotation member are unitary formed by pressing or resin molding.

8. A water pump according to claim 1, wherein the rotation member includes a transmitting portion to which a rotational driving force is transmitted and a connecting portion which connects between the transmitting portion and a fixing portion for the bearing, and the cover portion is fixed to a hole portion formed on the connecting portion via a fixing means.

9. A water pump according to claim 1, wherein the cover portion is fixed to the opening of the shaft portion via a fixing means.

10. A water pump according to claim 1, wherein the drain opening is provided at an end of the bearing side portion of the cylindrical space.

11. A water pump comprising:

a rotation member;

a hollow shaft having an opening on one end and connected to the rotation member for unitarily rotating with the rotation member, the hollow shaft being made of erosive material;

an impeller connected to the shaft portion at an opposite side of the opening for unitarily rotating with the shaft;

a body defining a fluid chamber in which the impeller is rotated;

a bearing rotatably supporting the shaft on the body;

a sealing member provided between the shaft portion and the body to seal the fluid chamber;

a cover facing the opening of the shaft and covering the opening from outside the shaft;

a cylindrical space defined between an external peripheral surface of the shaft portion and an internal peripheral surface of a cylindrical portion of the body, the sealing member being intermediately located in the cylindrical portion to divide the cylindrical space into an impeller side portion and a bearing side portion;

a drain opening provided at an end of the cylindrical space far discharging water leaked from the impeller side portion to the bearing side portion via the sealing member to atmosphere; and a through-bore provided either on the rotation member or the shaft portion to communicate the drain opening and the atmosphere;

wherein the cover portion covers the through-bore.

* * * * *